United States Patent [19]

Riedel

[11] Patent Number: 4,776,186

[45] Date of Patent: Oct. 11, 1988

[54] DECATIZING APPARATUS

[75] Inventor: Dieter Riedel, Porta Westfalica, Fed. Rep. of Germany

[73] Assignee: Johannes Menschner Maschinenfabrik GmbH & Co., KG, Viersen, Fed. Rep. of Germany

[21] Appl. No.: 58,127

[22] Filed: Jun. 4, 1987

[30] Foreign Application Priority Data

Sep. 3, 1986 [DE] Fed. Rep. of Germany ..... 3629963

[51] Int. Cl.[4] ..... D06B 5/08

[52] U.S. Cl. ..... 68/5 R

[58] Field of Search ..... 68/5 R, 5 D, 8, 5 B; 34/123, 111, 116, 117, 118; 8/149.3

[56] References Cited

U.S. PATENT DOCUMENTS 3,046,771 7/1962 Bailey ..... 68/5 R
4,622,758 11/1986 Lehtinen et al. ..... 34/116 X

FOREIGN PATENT DOCUMENTS 573623 3/1933 Fed. Rep. of Germany .
2456921 12/1976 Fed. Rep. of Germany .
322885 12/1929 United Kingdom .
616071 1/1949 United Kingdom ..... 68/5 B
1288735 9/1972 United Kingdom .
1404958 9/1975 United Kingdom .
1518905 7/1978 United Kingdom .

*Primary Examiner*—Philip R. Coe
*Attorney, Agent, or Firm*—Penrose Lucas Albright; Robert A. Miller

[57] ABSTRACT

In the decatizing apparatus of the present invention the fabric to be treated is fed around a rotatable, heated cylinder between a backing cloth and a tension thrust belt. The presence of the backing cloth between the surface of the cylinder and the fabric prevents the production of an excessive greasy gloss effect on the surface of the fabric closest to the cylinder. A moistening device may be provided to moisten the backing cloth before it passes around the cylinder. A wide variety of decatizing effects can be achieved by adjusting the temperature of the belt and cylinder, the tension of the belt, and the moisture content of the backing cloth and fabric.

5 Claims, 1 Drawing Sheet

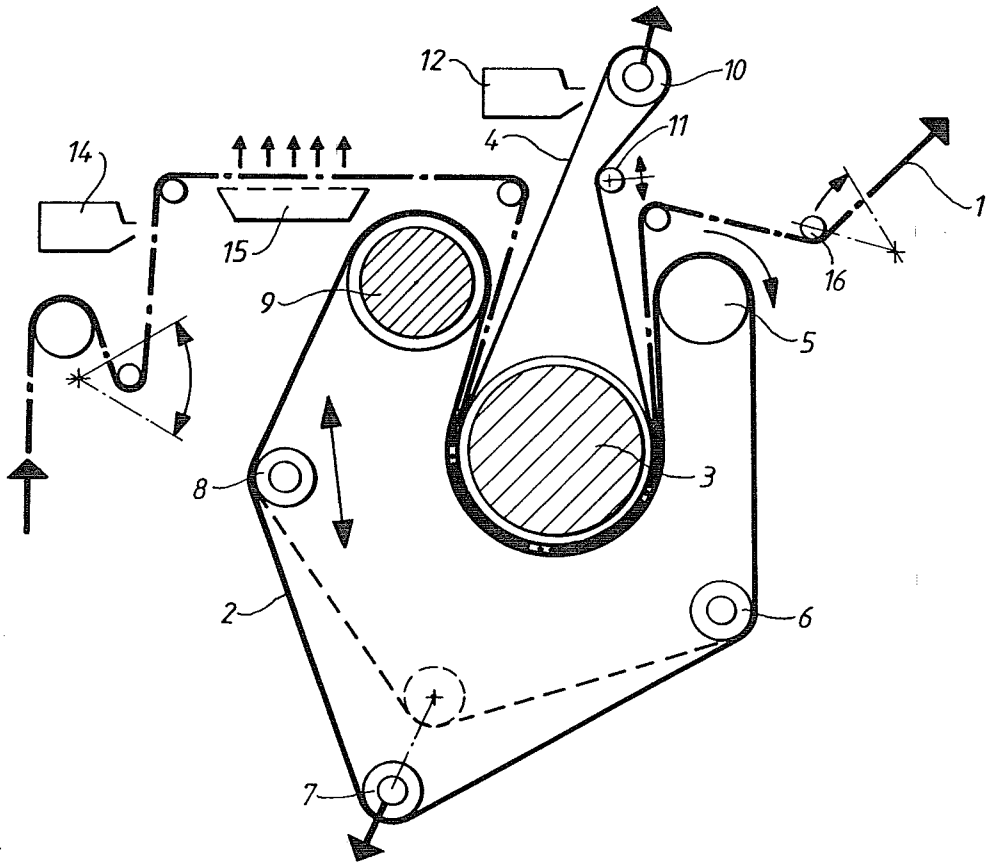
1
16
5
6
10
11
3
4
12
9
15
14
8
2
7

DECATIZING APPARATUS

BACKGROUND OF THE INVENTION

Technical Field

The present invention relates to apparatus for the continuous decatizing of fabrics, including woven or knitted fabrics, by subjecting the fabric to controlled heat, moisture and pressure treatment.

Prior Art

U.S. Pat. No. 4,102,643 (Riedel) discloses an apparatus for the continuous decatizing of woven fabrics or knitted fabrics, in which the fabric is passed directly over a rotatably mounted and heatable cylinder. A conventionally tensioned backing cloth is trained over a moisturizing device before it runs onto the cylinder adjacent the fabric. An impermeable thrust belt is looped around the cylinder, fabric and backing cloth. The fabric, which is held between the cylinder and the backing cloth is decatized by the application of pressure and moisture. With this apparatus, an excessive gloss effect (greasy lustre) occurs on one side of the fabric due to its direct contact with the heated cylinder, whereas a matt surface pattern forms on the opposite side of the fabric due to the direct contact with the backing cloth. The result is a different appearance of the fabric on the two sides, and this is a disadvantage.

The excessive gloss effect on one side of the fabric can be reduced by making the surface temperature of the thrust belt variable independently of the surface temperature of the cylinder by means of a deflecting roll situated in front of the cylinder, relative to the direction of movement of the thrust belt (DE-PS No. 2 727 514). Although the front or back of the fabric is in direct contact with the heated cylinder, and despite the extremely high pressure forces that the belt exerts on the fabric, this possibility of infinite control of the thrust belt temperature results in the fabric having only a moderate gloss. If the front of the fabric is in direct contact with the cylinder, then the temperature of the cylinder wall is reduced in comparison with the temperature of the thrust belt, while when the back of the fabric is in direct contact with the cylinder the temperature of the cylinder wall is reduced in comparison with the temperature of the thrust belt. However, reducing the temperature results in a reduction of the fabric fixing.

SUMMARY OF THE INVENTION

It is an object of the invention to provide a decatizing apparatus which guarantees a high degree of fixing of the fabric while avoiding the production of an excessive gloss effect (greasy lustre) on the fabric.

The present invention accordingly provides apparatus for the continuous decatizing of fabric, the apparatus including a rotatably mounted cylinder, means for heating the cylinder, a permeable backing cloth mounted so as to be movable around a path including a portion around and in contact with the cylinder, an impermeable thrust belt which passes around the cylinder outwardly of said backing cloth, and means for transporting fabric to be decatized around said cylinder between said thrust belt and said backing cloth.

The contact of the fabric with the backing cloth in the looping zone around the cylinder avoids excessive gloss without any need to reduce the temperature of the heatable cylinder, so that a satisfactory fixing effect is also guaranteed.

Preferably, the apparatus further includes a device which is operative to moisten the backing cloth before entry to the gap between the cylinder and the fabric to be decatized. It is preferably to control the amount of liquid leaving the moistening device, and this control may be independent of the tension of the thrust belt and the surface temperature of the cylinder, but may depend on the speed of conveyance of the fabric.

The continual moistening of the backing cloth makes additional moisture available during the pressing and fixing treatment. The amount of liquid introduced - the sum of the moisture component from the incoming fabric and the moisture component from the backing cloth - is thus converted to steam beneath the impermeable thrust belt. The moisture thus introduced can be converted to superheated steam during the pressing treatment, depending upon the temperatures between the cylinder, on the one hand, and the thrust belt, on the other hand.

In addition to the actual pressing operation, the steam evolution during the pressing operation results in a pronounced decatizing effect with excellent fixing.

The degree of fixing may also be controlled by preselection of the temperature of the cylinder and of the thrust belt without greasy lustre problems occurring.

In the bottom pressure range, with low tension and the thrust belt, this apparatus can be used as a continuous-finish decatizing machine. The resulting decatizing effects are far better than the prior art, because higher temperatures can be used than is the case with all conventional continuous decatizing machines. In addition, the apparatus according to the invention gives enormous savings in respect of energy and working capital. The controlled and readily monitored moisture component, which may be converted to superheated steam, means that in comparison with the known continuous decatizing devices only fractions of the heat requirements are needed, and are on average between 30 and 50 kg of steam per hour. The annual savings are considerable in practice, for example between DM 80 000 and DM 135 000. The investment costs for the apparatus according to the invention are also about 20% lower.

The intensive heat supply from both sides of the fabric results in an isochoric condition beneath the impermeable thrust belt for the entire steam component. The resulting internal expansion pressure then counteracts the mechanical contact pressure of the thrust belt. Thus the fabric is subjected only to the differential pressure arising from mechanical contact pressure from outside less the expansion pressure from within.

In practice this means that even extremely sensitive fabrics can be effectively pressed, decatized and fixed without any appreciable volumetric pressure or structural crushing occurring. The minimum differential pressure is obtained if the pressure resulting from the thrust belt contact force is preselected and set to be just slightly higher than the expansion pressure below the impermeable thrust belt. Critical values in practice are thus as follows:

1. Minimum volumetric pressure (continuous-finish decatizing)

Appropriate preselection of low thrust belt tension;

High expansion pressure obtained by increased backing cloth and fabric moisture components;

Temperature of heatable cylinder and heatable deflection roller in front of the same between 120°-150° C.;

Minimum volumetric pressure resulting in low surface pressure, high moisture component and high temperature.

2. Maximum volumetric pressure (continuous press-gloss decatizing)

Appropriate preselection to give high thrust belt tension;

Low expansion pressure by reducing backing cloth and fabric moisture content;

Temperature of heatable cylinder and heatable deflection roll in front of the same between 110° and 130° C.

Maximum volumetric pressure resulting in high tension, low moisture and relatively low temperature.

Those versed in the art will clearly see the range of variation with which the apparatus according to the invention can operate.

A decatizing apparatus according to the invention will now be described, by way of example only, with reference to the accompanying diagrammatic drawing.

BRIEF DESCRIPTION OF THE DRAWING

The single FIGURE shows a vertical section through the apparatus transversely of the direction of fabric movement.

A strip of fabric 1, which is to be decatized, is pressed, by a thrust belt 2, which is subjected to high longitudinal tension, against a backing cloth 4 which rotates in synchronism with a heatable cylinder 3.

The thrust belt 2 is looped around deflecting rolls 5–9, deflecting roll 5 being the drive roll and deflecting roll 7 the tensioning roll for the thrust belt 2. Deflecting roll 9 is heatable so as to heat the belt 2.

The deflecting rolls 6–9 and the heatable cylinder 3 have no individual drives and thus rotate freely.

A control roller 8 is also provided for correct tracking of the thrust belt 2 and also to ensure that the thrust belt always rotates centrally.

The drive and the contact pressure of the thrust belt 2 on the backing cloth 4 and hence on the cylinder 3 ensures that the backing cloth 4 also moves without an individual drive and therefore moves in synchronism with the belt 2.

In the path of its rotation above the pressing and fixing zone around the cylinder, the backing cloth 4 passes through a tensioning device 10 and a control device 11 for correctly tracking and ensuring central rotation.

The backing cloth 4 is endless, has a very fine surface structure, is resistant to high temperatures, mechanically strong and permeable. An important feature is that the backing cloth 4 is controllable and continuously moistened by a moistening device 12 outside the pressing and fixing zone (looping zone) which is around the cylinder 3. The amount of liquid leaving the moistening device is controlled in accordance with a predetermined basic setting with proportional adjustment to the speed of movement of the fabric 1.

It is also advantageous for the fabric 1 to be supplied to the cylinder 3 in a 13–20% relative-moisture condition. this can be achieved by the use of a moistening device 14 and/or by a steaming table 15.

The moistening device 14 and steaming table 15 can be dispensed with if the fabric 1 is available with a correspondingly high entry moisture, e.g. by appropriate control of the preceding drying process with a higher output moisture than usual. This method also saves energy during drying. Moistening of the backing cloth 4 and the moisture component in the fabric 1 introduce a corresponding amount of water into the pressing and fixing zone of the cylinder 3. This moisture is converted to steam in the range up to superheated steam beneath the impermeable and tensioned thrust belt 2 by means of the temperature of the heatable deflecting roll 9 which heats the thrust belt 2, and the temperature of the cylinder 3, which belt and cylinder operate on the fabric, backing cloth combination from both sides. A decatizing and fixing effect thus results in addition to a pressing effect. The degree of decatizing, fixing and pressing in dependent upon the amount of moisture supplied by the moisturizing devices 12 and 14 and on the steaming table 15, and the magnitude of the contact pressure of the thrust belt 2, and can thus be varied within wide limits.

The control and presetting of the surface temperatures of the thrust belt 2 and cylinder 3 are also a means of adjusting and setting the intensity of the fixing action provided by the decatizing and pressing effect.

As soon as the fabric 1 leaves the cylinder 3, the steam is liberated and the fabric 1 must then be cooled. A non-loaded jockey roll 16 provides tension-free conveyance of the fabric 1 to a cooling station.

For many fabric qualities, the fabric treatment using the apparatus according to the invention will be the final finishing stage.

I claim:

1. Apparatus for the continuous decatizing of fabric, the apparatus including a rotatably mounted cylinder, means for heating the cylinder, a permeable backing cloth mounted so as to be movable around a path including a portion around and in contact with the cylinder, an impermeable thrust belt which passes around the cylinder outwardly of said backing cloth, and means for transporting fabric to be decatized around said cylinder between said thrust belt and said backing cloth.

2. Apparatus according to claim 1, further including a device which is operative to moisten the backing cloth with liquid, said transporting means driving said backing cloth through said moistening device before said cloth passes around said cylinder.

3. Apparatus according to claim 2, further including control means for controlling the amount of liquid leaving said moistening device.

4. Apparatus according to claim 3, in which said control means is operative independently of the tension in the thrust belt and the surface temperature of the cylinder.

5. Apparatus according to claim 3, in which said control means is operative in dependence on the speed of conveyance of the fabric by said transporting means.

* * * * *